US008046945B2

(12) United States Patent
Radcliffe

(10) Patent No.: US 8,046,945 B2
(45) Date of Patent: Nov. 1, 2011

(54) TRANSPARENT PICTURE FRAME

(76) Inventor: Arthur J. Radcliffe, Ann Arbor, MI (US)

( * ) Notice: Subject to any disclaimer, the term of this patent is extended or adjusted under 35 U.S.C. 154(b) by 0 days.

(21) Appl. No.: 12/509,663

(22) Filed: Jul. 27, 2009

(65) Prior Publication Data

US 2011/0016758 A1 Jan. 27, 2011

(51) Int. Cl.
*A47G 1/06* (2006.01)

(52) U.S. Cl. ..... 40/737; 40/772; 40/781

(58) Field of Classification Search ..... 40/737, 40/772, 700, 768, 781, 798
See application file for complete search history.

(56) References Cited

U.S. PATENT DOCUMENTS

| | | | | | |
|---|---|---|---|---|---|
| 1,778,636 | A | | 10/1930 | Herbert | |
| 1,807,288 | A | | 5/1931 | Herbert | |
| 1,809,786 | A | | 6/1931 | Le Jeune | |
| 2,603,018 | A | * | 7/1952 | Cross | 40/768 |
| 3,707,053 | A | | 12/1972 | Itano | |
| 4,091,555 | A | * | 5/1978 | Korzon | 40/761 |
| 4,187,630 | A | | 2/1980 | Giulie et al. | |
| 4,204,350 | A | | 5/1980 | Brenner | |
| 4,282,668 | A | * | 8/1981 | Jolkovski | 40/790 |
| 4,310,976 | A | * | 1/1982 | Wilten | 40/737 |
| 5,012,600 | A | * | 5/1991 | Wang | 40/737 |
| 5,148,618 | A | | 9/1992 | Brewster | |
| 5,279,880 | A | * | 1/1994 | Cohart | 428/138 |
| 5,383,293 | A | * | 1/1995 | Royal | 40/768 |
| 5,586,401 | A | | 12/1996 | Sheehan et al. | |
| 5,960,573 | A | | 10/1999 | Wong | |
| 5,979,097 | A | | 11/1999 | Moore | |
| 6,209,248 | B1 | | 4/2001 | Reinhard | |
| 6,574,896 | B1 | * | 6/2003 | Howell | 40/737 |
| 7,320,195 | B1 | * | 1/2008 | Kushner | 40/781 |
| 2007/0089343 | A1 | | 4/2007 | Goldman | |
| 2008/0000127 | A1 | * | 1/2008 | Shimer | 40/768 |

* cited by examiner

*Primary Examiner* — Gary Hoge
(74) *Attorney, Agent, or Firm* — Gifford, Krass, Sprinkle, Anderson & Citkowski, P.C.

(57) ABSTRACT

A transparent picture frame allows artwork to appear more prominent relative to surrounding wall surfaces. The assembly includes a transparent cover plate having dimensions corresponding to the dimensions of the artwork, a transparent inner mat portion having a cut-out dimensioned to receive the cover plate and artwork, and a transparent outer mat portion having a cut-out with dimensions less than those of the inner mat portion, resulting in a peripheral overlap. The assembly further includes a transparent back panel, wherein the inner mat portion, outer mat portion and back panel all have the same outer dimensions. One or more fasteners are provided for holding the assembly together in the following order from front-to back: the outer mat portion, the inner mat portion with the cover plate over the artwork, and the back panel. In the preferred embodiment, the inner mat portion, outer mat portion and back panel are made of plastic, whereas the cover plate is made of glass.

8 Claims, 2 Drawing Sheets

TRANSPARENT PICTURE FRAME

FIELD OF THE INVENTION

This invention relates generally to picture framing and, in particular, to a transparent frame with multiple transparent components, allowing artwork to appear more prominent relative to surrounding wall surfaces.

BACKGROUND OF THE INVENTION

The way in which artwork is framed if often very important in terms of aesthetic appeal. For the work of old masters, ornate wooden frames may be the acceptable, whereas for modern prints, frames with straighter edges are probably more appropriate.

For certain types of works, including photographs, it may be advantageous to use a frame that more effectively blends in with surrounding wall surfaces.

SUMMARY OF THE INVENTION

This invention improves upon existing designs by providing a transparent picture frame with multiple transparent components, allowing artwork to appear more prominent relative to surrounding wall surfaces. The assembly includes a transparent cover plate having dimensions corresponding to the dimensions of the artwork, a transparent inner mat portion having a cut-out dimensioned to receive the cover plate and artwork, and a transparent outer mat portion having a cut-out with dimensions less than those of the inner mat portion, resulting in a peripheral overlap.

The assembly further includes a transparent back panel, wherein the inner mat portion, outer mat portion and back panel all have the same outer dimensions. One or more fasteners are provided for holding the assembly together in the following order from front-to back: the outer mat portion, the inner mat portion with the cover plate over the artwork, and the back panel.

In the preferred embodiment, the inner mat portion, outer mat portion and back panel are made of plastic, whereas the cover plate is made of glass. The thickness of the cover plate and the inner mat portion are substantially the same or similar to account for the thickness of the artwork. The inner mat portion, outer mat portion and back panel are preferably rectangular, though other shapes may be used, including shapes with rounded edges, such as ovals and circles. The cover plate and cut-outs in the inner and outer mat portion are also preferably rectangular, though as with the outer dimensions, the invention is not limited in this regard.

The fasteners may be positioned through holes in the inner mat portion, outer mat portion and back panel, or clips may be applied to the peripheral edges of the assembled structure.

DETAILED DESCRIPTION OF THE INVENTION

Figure 1:
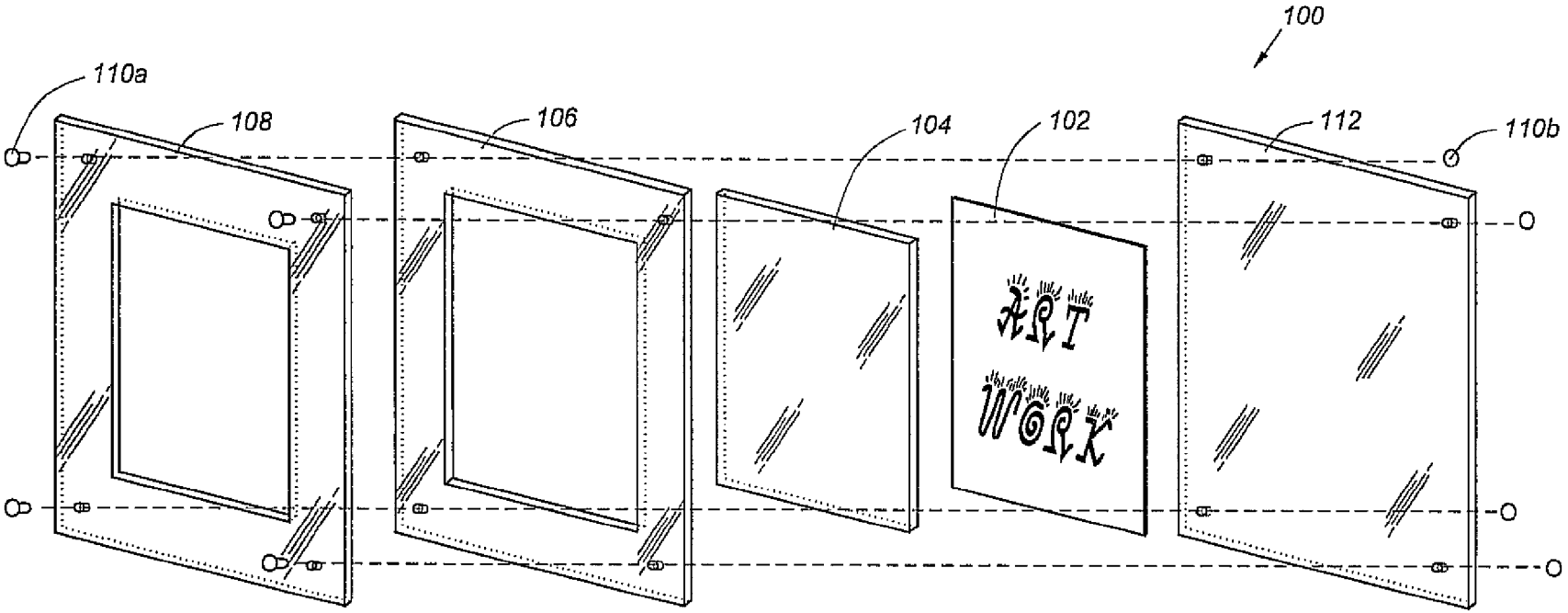
FIG. 1 is an exploded view of the preferred embodiment of the invention.

Now making reference to the drawings, FIG. 1 is an exploded view of the preferred embodiment of the invention. The assembly includes an outer mat portion 108 disposed over an inner mat portion 106. The inner mat portion 106 includes a rectangular cut-out physically dimensioned to receive a cover plate 104. The cover plate is preferably the same size as artwork 102, which may be a photograph, drawing, etc.

Figure 2:
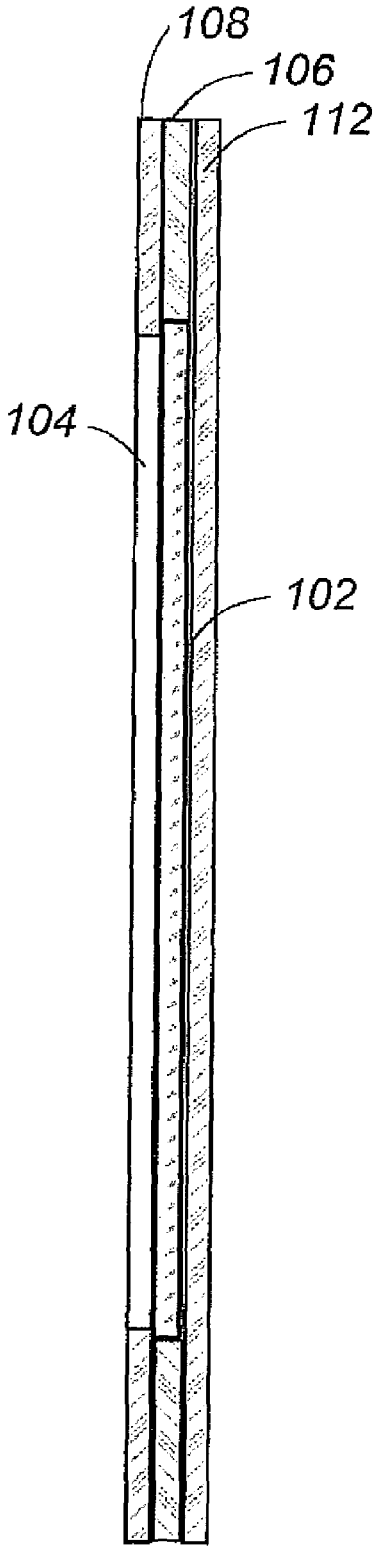
FIG. 2 is a side view in cross section of the preferred embodiment.
Figure 3:
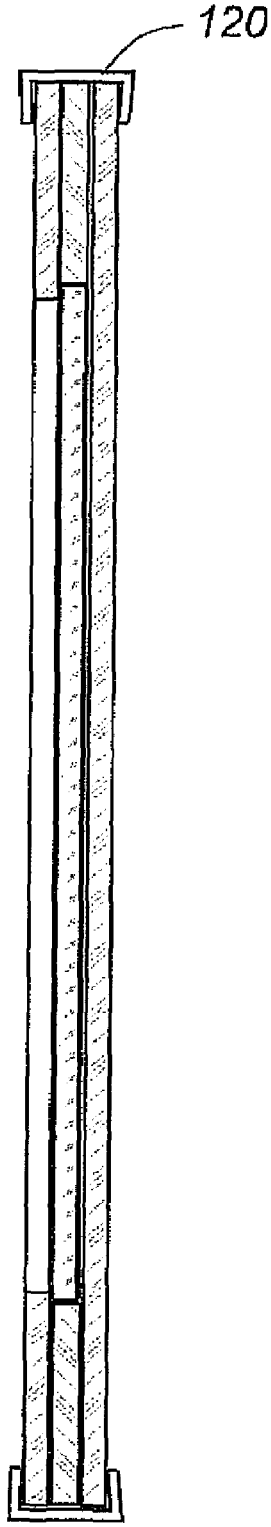
FIG. 3 is a side view in cross section of an alternative embodiment of the invention.

The cutout of the outer mat portion 108 is smaller than the cutout of the inner mat portion 106, resulting in a peripheral overlap as shown in FIG. 2. The overlap is preferably in the range of from ⅛" to ⅜". A back panel 112 completes the assembly. The outer and inner mat portions and the back panel are held together in a sandwich-like structure. In one embodiment, holes are drilled through the outer and inner mat portions and the back panel, and rivets or two-part fasteners such as nuts/bolts 110*a*, 110*b* may be used. Alternatively, clips may be applied peripherally, as shown in FIG. 3. Such clips may be of any convenient length, such as one to several inches, and may applied only on the top and bottom, or on the sides, or all around.

In the preferred embodiment, the outer mat, inner mat and back panel are dimensionally the same, and all are preferably made of transparent plastic with thicknesses in the range of 1/16' to ¼" or more. While clear plastic may also be used for the cover plate, a transparent glass panel is preferably used instead to resist scratches.

Using this structure, the artwork is fully encased and protected while allowing surrounding wall sections to be visible through the transparent border for enhanced aesthetic appeal.

I claim:

1. A transparent picture frame for artwork having dimensions, comprising:

a transparent cover plate having dimensions corresponding to the dimensions of the artwork;

a transparent inner mat portion having a cut-out dimensioned to receive the cover plate and artwork;

a transparent outer mat portion having a cut-out with dimensions less than those of the inner mat portion, resulting in a peripheral overlap;

a transparent back panel;

wherein the inner mat portion, outer mat portion and back panel all have the same outer dimensions; and one or more fasteners for holding the assembly together in the following order from front-to back:

the outer mat portion, the inner mat portion with the cover plate over the artwork, and the back panel.

2. The transparent picture frame of claim 1, wherein at least the inner mat portion, outer mat portion and back panel are made of plastic.

3. The transparent picture frame of claim 1, wherein at least the cover plate is made of glass.

4. The transparent picture frame of claim 1, wherein the thickness of the cover plate and the inner mat portion are substantially the same.

5. The transparent picture frame of claim 1, wherein the inner mat portion, outer mat portion and back panel are rectangular.

6. The transparent picture frame of claim 1, wherein the cover plate and cut-outs in the inner and outer mat portion are rectangular.

7. The transparent picture frame of claim 1, wherein the fasteners are positioned through holes in the inner mat portion, outer mat portion and back panel.

8. The transparent picture frame of claim 1, wherein the fasteners are clips applied to the peripheral edges of the assembled frame.

* * * * *